United States Patent [19]

Harrington

[11] Patent Number: 4,998,471

[45] Date of Patent: Mar. 12, 1991

[54] SCREEN PRINTING SYSTEM AND METHOD

[76] Inventor: Robert J. Harrington, 3451 Harrington Rd., Dunkirk, N.Y. 14048

[21] Appl. No.: 462,561

[22] Filed: Jan. 9, 1990

[51] Int. Cl.[5] ..... B05C 17/08; B41L 13/00

[52] U.S. Cl. ..... 101/126; 101/474

[58] Field of Search ..... 101/126, 474; 38/102, 38/102.1, 102.2; 269/254 R; 223/84

[56] References Cited

U.S. PATENT DOCUMENTS

| | | | |
|---|---|---|---|
| 2,607,290 | 4/1949 | Runge | 101/126 |
| 3,244,093 | 4/1966 | Vasilantone | 101/126 |
| 4,388,862 | 6/1983 | Thomas, Jr. | 101/128 |
| 4,644,639 | 2/1987 | Atteberry et al. | 38/102.2 |

*Primary Examiner*—Edgar S. Burr
*Assistant Examiner*—C. A. Bennett
*Attorney, Agent, or Firm*—Wayne L. Lovercheck; Charles L. Lovercheck; Dale Lovercheck

[57] ABSTRACT

A screen printing system and method is provided in accordance with the invention by using a circular base, a screen, an article to be printed and ink. The circular base has a planar top face. The circular base supports the article to be printed, such as an item of clothing made from cloth. The screen is held in a planar position by a rigid frame. The plane of the screen is positioned above and parallel to the plane of the top face of the circular base. The circular base has a side face with a groove therein which is adapted to hold a resilient flexible annular member. The resilient flexible annular member evenly holds the article to be printed to the circular base so that no wrinkles are allowed to remain in the article to be printed. If wrinkles were allowed to remain in the article to be printed then the pattern of the design to be printed would be distorted on the printed article. The screen includes a fine mesh cloth of fibrous material, such as, silk or nylon or similar filament. The holes in the screen are selectively filled by well known procedures to leave unfilled holes in the pattern of the design to be printed on the article to be printed. Ink is then passed through the screen onto the article to be printed to form a printed article. The ink on the printed article is then dried.

7 Claims, 1 Drawing Sheet

SCREEN PRINTING SYSTEM AND METHOD

BACKGROUND OF THE INVENTION

The invention relates to a screen printing system and method. In particular, the invention provides an improved screen printing system and method. The improvements of the invention each taken alone or in combination add to resolve the distortion problems of prior art systems and methods for screen printing, and particularly when printing a thick or multiple layered article such as a jacket, for example.

STATEMENT OF PRIOR ART

U.S. Pat. No. 4,388,862 to Thomas discloses a vacuum apparatus for silk screen printing which uses a rectangular frame. This apparatus is expensive and does not provide for the removal of wrinkles from the garments being printed. Thus, garments and particularly jackets and other thick or multiple layered garments having images distorted at the wrinkles are produced.

One problem of prior art apparatuses and methods for screen printing is that the images produced thereby are distorted. Another problem of prior art screen printing is that the article upon which an image is produced is not held evenly during the printing process. Another problem of prior art screen printing is that thick or multiple layered articles are not held securely and may shift during the printing process, resulting in a distorted or overprinted image, with colors overlying other colors.

The improvement of the present invention beneficially provides a novel, non-obvious and useful manner of screen printing by which articles having undistorted images are produced and the proper register or position is maintained as various colors are printed on the same article.

BRIEF DESCRIPTION OF THE INVENTION

These problems of the prior art are overcome by the improved circular screen printing system and method of the present invention. Products having distorted images are prevented in a circular screen printing system and method in accordance with the present invention.

A screen printing system and method is provided in accordance with the invention by using a circular base, a screen, an article to be printed and ink. The circular base has a substantially planar top face. The circular base supports the article to be printed, such as an item of clothing made from cloth. The screen is held substantially planar by a rigid frame. The plane of the screen is positioned above and substantially parallel to the plane of the top face of the circular base. The circular base has a side face with a groove therein which is adapted to hold a resilient flexible annular member. The resilient flexible annular member substantially evenly holds the article to be printed to the circular base so that no wrinkles are allowed to remain in the article to be printed. If wrinkles were allowed to remain in the article to be printed then the pattern of the design to be printed would be distorted on the printed article.

The circular base includes two handles. A rigid annular member is provided which is adapted to be positioned on the handles of the circular base. A mounting bracket is connected to the circular base.

The screen includes a fine mesh cloth of fibrous material, such as, silk or nylon or similar filament. In a preferred embodiment of the invention the holes in the screen are selectively filled by well known procedures to leave unfilled holes in the pattern of the design to be printed on the article to be printed. Ink is then passed through the screen onto the article to be printed to form a printed article. The ink on the printed article is then dried.

It is an object of the invention to provide a screen printing system using liquid ink, a screen, an article to be printed, and a circular base, in which the circular base has a planar top face which supports the article to be printed.

Another object of the invention to provide a screen printing system using liquid ink, a screen, an article to be printed, a circular base, and a resilient flexible annular member adapted to hold the article to the article to the circular base.

Another object of the invention to provide a screen printing system using liquid ink, a screen, an article to be printed, and a circular base, in which the portion of the article upon which ink is received is held without wrinkles in a plane parallel to the plane of the screen.

Another object of the invention to provide a screen printing method in which a circular base, a screen, an article to be printed and ink are provided.

Another object of the invention to provide a screen printing method in which a circular base, a screen, an article to be printed and ink are provided, and ink is passed through the screen onto the article.

Another object of the invention to provide a screen printing method in which a circular base, a screen, an article to be printed and ink are provided, and ink is passed through the screen onto a portion of the article being evenly held without wrinkles.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE PREFERRED EMBODIMENT

Figure 1:
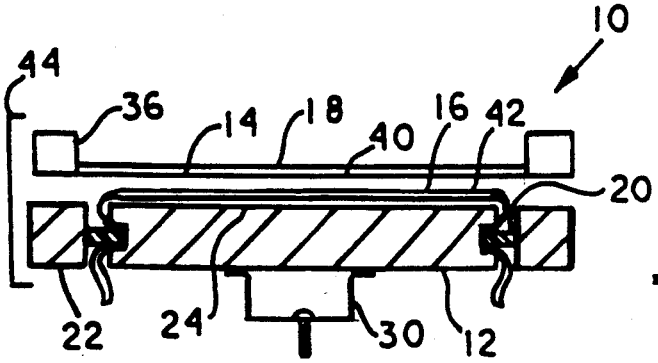
FIG. 1 is a cross-sectional view of a circular screen printing system taken on line 1—1 of FIG. 2 in accordance with the invention.
Figure 2:
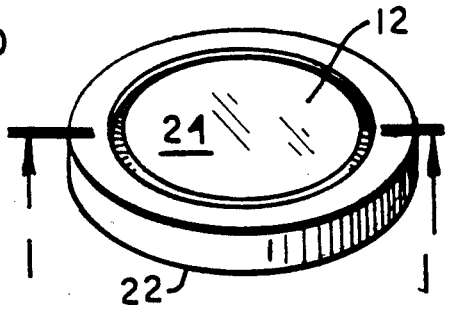
FIG. 2 is a perspective view of the circular screen printing system in accordance with the invention.

The preferred embodiment of the invention is illustrated by way of example in FIGS. 1 through 6. Referring to the FIGS., in which like numerals refer to like portions thereof, FIGS. 1 and 2 show a circular screen printing system 10 in accordance with the present invention. System 10 includes circular base 12, screen 14, article 16 to be printed and ink 18. Article 16 is held to circular base 12 by resilient flexible annular member 20. Rigid annular member 22 is positioned adjacent to resilient flexible annular member 20.

Figure 3:
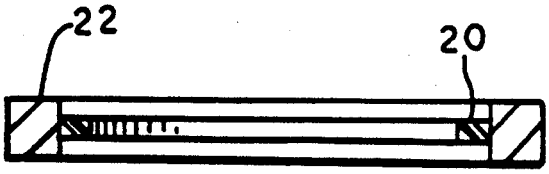
FIG. 3 is a cross-sectional view taken on line 3—3 of FIG. 4 of a resilient flexible annular member of the circular screen printing system in accordance with the invention.
Figure 4:
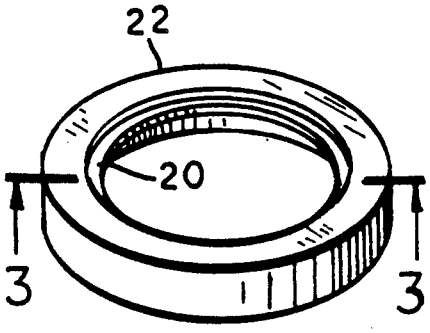
FIG. 4 is a perspective view of a resilient flexible annular member of a circular screen printing system in accordance with the invention.

With more particular reference to FIGS. 3 and 4, it is seen that resilient flexible annular member 20 is positioned adjacent to rigid annular member 22. Rigid annular member 22 is adapted to be supported by circular base 12. Rigid annular member 22 is adapted to hold resilient flexible annular member 20 against article 16 and circular base 12.

Figure 5:
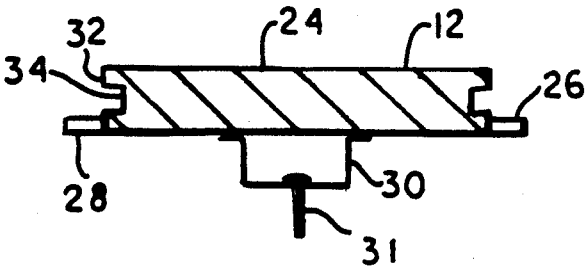
FIG. 5 is a cross-sectional view taken on line 5—5 of FIG. 6 of the circular base of a circular screen printing system in accordance with the invention.
Figure 6:
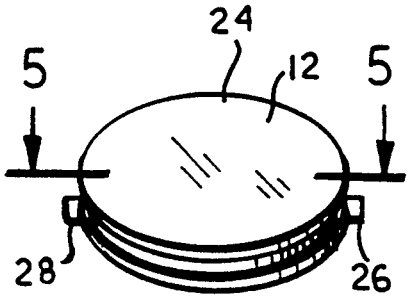
FIG. 6 is a perspective view of the circular base of a circular screen printing system in accordance with the invention.

With more particular reference to FIGS. 5 and 6, it is seen that circular base 12 has a substantially planar top face 24. Circular base 12 includes two handles 26 and 28. Rigid annular member 22 is adapted to be positioned on handles 26 and 28 of circular base 12. Mounting bracket 30 is connected to circular base 12. Mounting bracket 30 is adapted to be connected by bolt 31 to a supporting body.

Circular base 12 supports article 16 to be printed, such as an item of clothing made from cloth. Screen 14 is held in a planar position by rigid frame 36. Frame 36 is circular. In printing position planar portion 40 of screen 14 is positioned above and parallel to the plane of top face 24 of circular base 12. Circular base 12 has side face 32 with groove 34 therein, which is adapted to hold resilient flexible annular member 20. Resilient flexible annular member 20 evenly holds article 16 to be printed to circular base 12 so that no wrinkles are allowed to remain in planar portion 42 of article 16. If wrinkles were allowed to remain in article 16 to be printed, then the pattern of the design to be printed would be distorted on the printed article or if register is not maintained between the printing of different colors on the same article, then overprinting will occur and the resulting product will be flawed and unsuitable for use. In printing position, planar portion 40 of screen 14 is positioned above and parallel to planar portion 42 of article 16. Optionally, frame 36 is then clamped by clamp 44 to circular base 12.

Screen 14 preferably consists of a fine mesh of fibrous material, such as, silk or nylon or similar filament, as is used in conventional screen printing. In a preferred embodiment of the invention, the holes in the screen (i.e. the apertures between adjacent filaments of the fine mesh of fibrous material) are selectively filled by known screen printing procedures to leave unfilled holes in the pattern of the design to be printed on the article to be printed. Ink is then passed through the screen onto the article to be printed to form a printed article. The ink on the printed article is then dried. In a preferred embodiment of the invention, using a heat curable ink, drying may be accomplished by heating to about 100 degrees Centigrade for about one minute.

In operation, the screen printing method in accordance with the invention, provides circular base 12, screen 14, article 16 to be printed and ink 18. Screen 14 is held by rigid circular frame 36. Circular base 12 has planar top face 24 which supports article 16 to be printed. Article 16 is held in position using resilient flexible annular member 20, which evenly holds article 16 to circular base 12. Planar portion 42 of article 16, upon which ink 18 is received, is held without wrinkles in a plane parallel to the plane of planar portion 40 of screen 14. Screen 14 is positioned above and parallel to both article 16 and the top face of circular base 12. Screen 14 is then clamped so that it cannot move relative to circular base 12. Ink is then passed through screen 14 onto article 16. The ink is then dried. Some screen printing inks are air dried. Other screen printing inks require heating.

The inks used in accordance with the method of the invention are those known to be useful for printing on the articles being printed, and in particular those inks useful for screen printing. For example, U.S. Pat. No. 4,388,862 discloses at column 2, lines 12 and 13 the use of highly-viscous ink for printing jackets.

The articles to be printed in accordance with the method of the invention are those known to be useful in screen printing. Such articles are made of any flexible material which is flat or at least a portion of which may be held in a flattened position. Cloth articles, for example, items of clothing, such as shirts are useful for printing in accordance with the method of the invention. Thick and multiple layered garments such as jackets, may accurately be imprinted in accordance with the method of the invention.

Frame 36 is preferably circular, but may also be rectangular. In a preferred embodiment of the invention drying may be accomplished by heating to about 100 degrees Centigrade for about one minute.

EXAMPLE

The pattern of a design to be printed is formed on a planar portion of a circular silk screen as unfilled apertures between its fibers. Article 16, which may be a jacket to be printed, is positioned on circular base 12. Article 16 is held in position in groove 34 in the side face of circular base 12 by resilient flexible annular member 20. The portion of article 16 to be printed is held evenly and without wrinkles in a plane parallel to the plane of the upper face 24 of circular base 12. Circular frame 36 of the circular screen is positioned over circular base 12 and clamped thereto so that it cannot move relative to circular base 12. In this clamped position the planar portion of article 16 is parallel to the planar portion of the screen. Ink 18 is distributed over the upper face of circular screen 14. By pressing with a squeegee the ink passes through the unfilled apertures between the fibers of the circular screen to form the pattern of the design to be printed on the article 16 without distortion.

The circular frame 12 of the circular screen 14 is then unclamped and lifted from the circular base 12. The resilient flexible annular member 20 is then removed from the circular base 12. Article 16, printed with an undistorted pattern of the design, is then removed from circular base 12, and placed on a drying shelf until the ink is fully dried.

While the present invention has been disclosed in connection with the preferred embodiment thereof, it should be understood that there may be other embodiments which fall within the spirit and scope of the invention as defined by the following claims.

The embodiments of the invention in which an exclusive property or privilege is claimed are defined as follows:

1. A screen printing system, comprising:

a screen, an article to be printed, and a circular base, said circular base having a substantially planar top face, said circular base supporting said article to be printed on said planar top face, at least a portion of said screen being substantially planar, said planar portion of said screen being positioned above and substantially parallel to said top face of said circular base, a resilient flexible annular member, said resilient flexible annular member being adapted to hold said article to said circular base, said circular base further comprises a side face, said side face comprising a groove, said groove being adapted to receive said resilient flexible annular member, a rigid annular member, said rigid annular member being adapted to support said resilient flexible annual member along the inner circumference thereof, said rigid annular member being adapted to hold said resilient flexible annular member against the portion of said article in said groove of said circular base.

2. The screen printing system recited in claim 1 wherein said circular base further comprises a first and a second handle, said rigid annular member being adapted to be positioned on said handles of said circular base.

3. The screen printing system recited in claim 1 further comprising a mounting bracket, said mounting bracket being connected to said circular base.

4. The screen printing system recited in claim 1 wherein said article to be printed comprises a portion held by said resilient flexible annular member and a portion upon which ink may be received.

5. The screen printing system recited in claim 1 wherein said screen comprises a rigid frame.

6. A screen printing system, comprising:

liquid ink, a circular screen, an article to be printed, and a circular base, said circular base having a substantially planar top face, said circular base supporting said article to be printed on said planar top face, at least a portion of said circular screen being substantially planar, said planar portion of said circular screen being positioned above and substantially parallel to said top face of said circular base, said liquid ink being supported by said planar portion of said circular screen, said circular base having a side face, said side face having a groove, a resilient flexible annular member, said resilient flexible annular member being adapted to hold said article to said circular base, said groove supporting said portion of said article to be printed held by said resilient flexible annular member whereby said portion of said article upon which ink is received is held substantially without wrinkles in a plane parallel to the plane of said planar portion of said screen.

7. A hold down mechanism to uniformly stretch and securely restrain an article of apparel in a printing position in a screen printing system comprising:

a circular base having a substantially planar top face providing a printing area and a side face having a substantially cylindrical surface, said side face having a groove extending generally around said cylindrical surface, a rigid annular member having an inner and an outer circumference, a resilient flexible annular member attached to said rigid annular member along said inner circumference thereof, said rigid annular member being adapted to be positioned around said circular base, said resilient flexible annular member extending into said groove in a forced fit relationship when said rigid annular member is positioned around said circular base whereby said resilient flexible member will stretch said article of apparel uniformly over said top face of said circular base and engage said article of apparel in said groove in said side face holding said article of apparel securely in position while said article of apparel is printed.

* * * * *